United States Patent [19]

Rossini

[11] 4,102,375

[45] Jul. 25, 1978

[54] VARIABLE-LENGTH TOOL HOLDER

[76] Inventor: James L. Rossini, 1025 Cedar Pl., Oakdale, Calif. 95361

[21] Appl. No.: 764,461

[22] Filed: Jan. 31, 1977

[51] Int. Cl.[2] ..... B25G 1/00

[52] U.S. Cl. ..... 145/75; 81/177 A; 279/79

[58] Field of Search ..... 81/177 A; 145/75, 50 R, 145/50 A, 50 B; 403/43, 118; 279/79

[56] References Cited

U.S. PATENT DOCUMENTS

| | | | |
|---|---|---|---|
| 1,145,597 | 7/1915 | Kopacki | 81/177 A |
| 1,814,274 | 7/1931 | Williamson | 279/79 |
| 2,725,086 | 11/1955 | Keyes et al. | 81/177 A |
| 2,805,594 | 9/1957 | Fogel | 279/79 |
| 3,306,639 | 2/1967 | Lyon | 81/177 A |
| 3,376,644 | 4/1968 | Clarke | 403/118 |
| 3,824,881 | 7/1974 | Wright | 145/75 |

*Primary Examiner*—Robert C. Watson

*Attorney, Agent, or Firm*—Clarence A. O'Brien; Harvey B. Jacobson

[57] ABSTRACT

A variable-length tool holder having a shank assembly including a hollow shank into which a shaft is adjustably inserted. Mounted on the shaft is a bit holder for retaining a tool bit on the shank assembly. The hollow shank forms a hole having a non-circular cross section, with the shaft also having a non-circular cross section and mating in the cross section of the hole of the shank for rotating with the shank. External screw threads are cut into the shaft for threadedly engaging with the internal screw threads of a nut rotatably attached to the shank in order to permit axial movement of the shaft relative to the shank by rotation of the nut.

7 Claims, 15 Drawing Figures

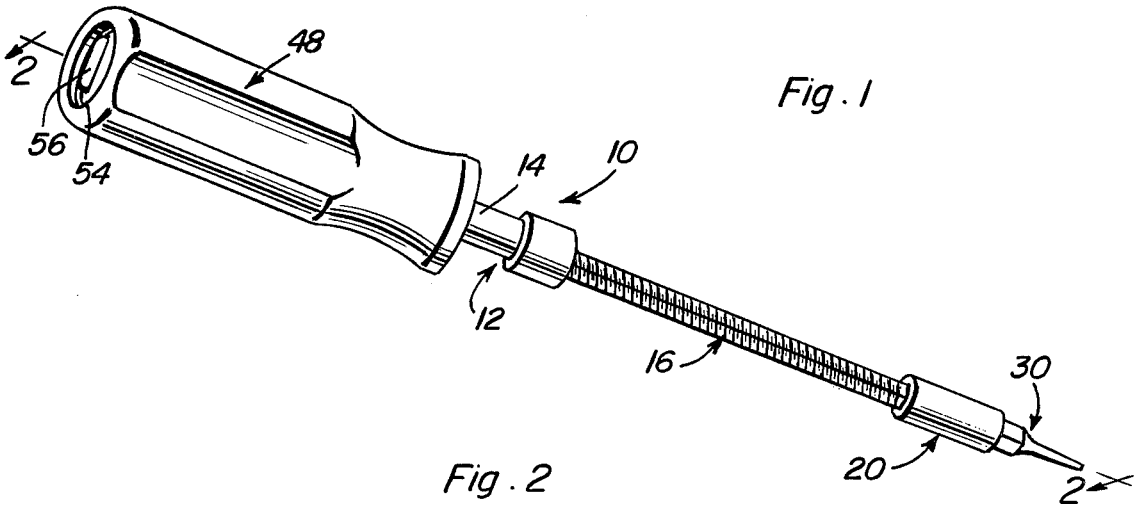
Fig. 1
Fig. 2
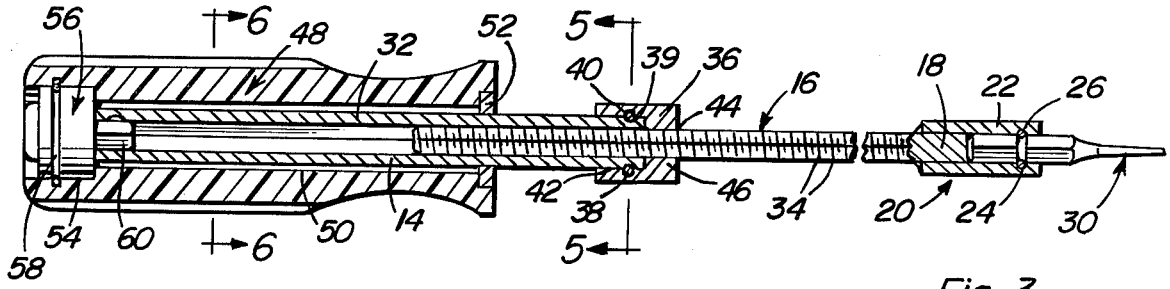
Fig. 3
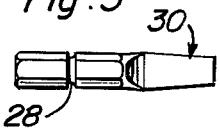
Fig. 4
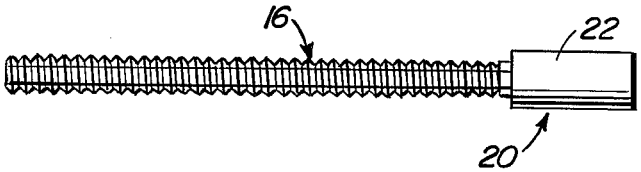
Fig. 6
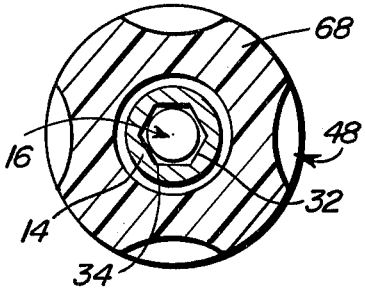
Fig. 7
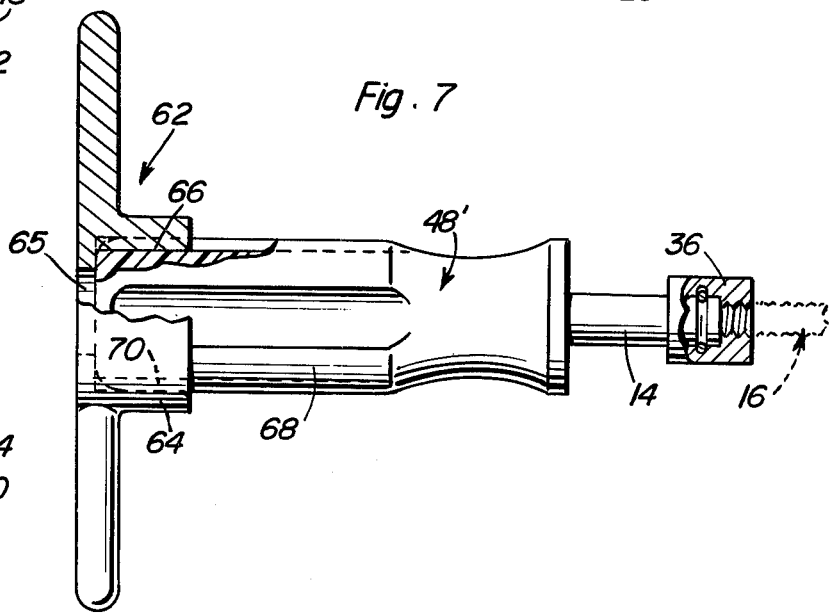
Fig. 5
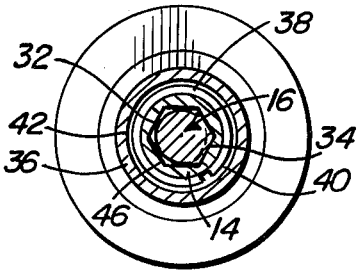

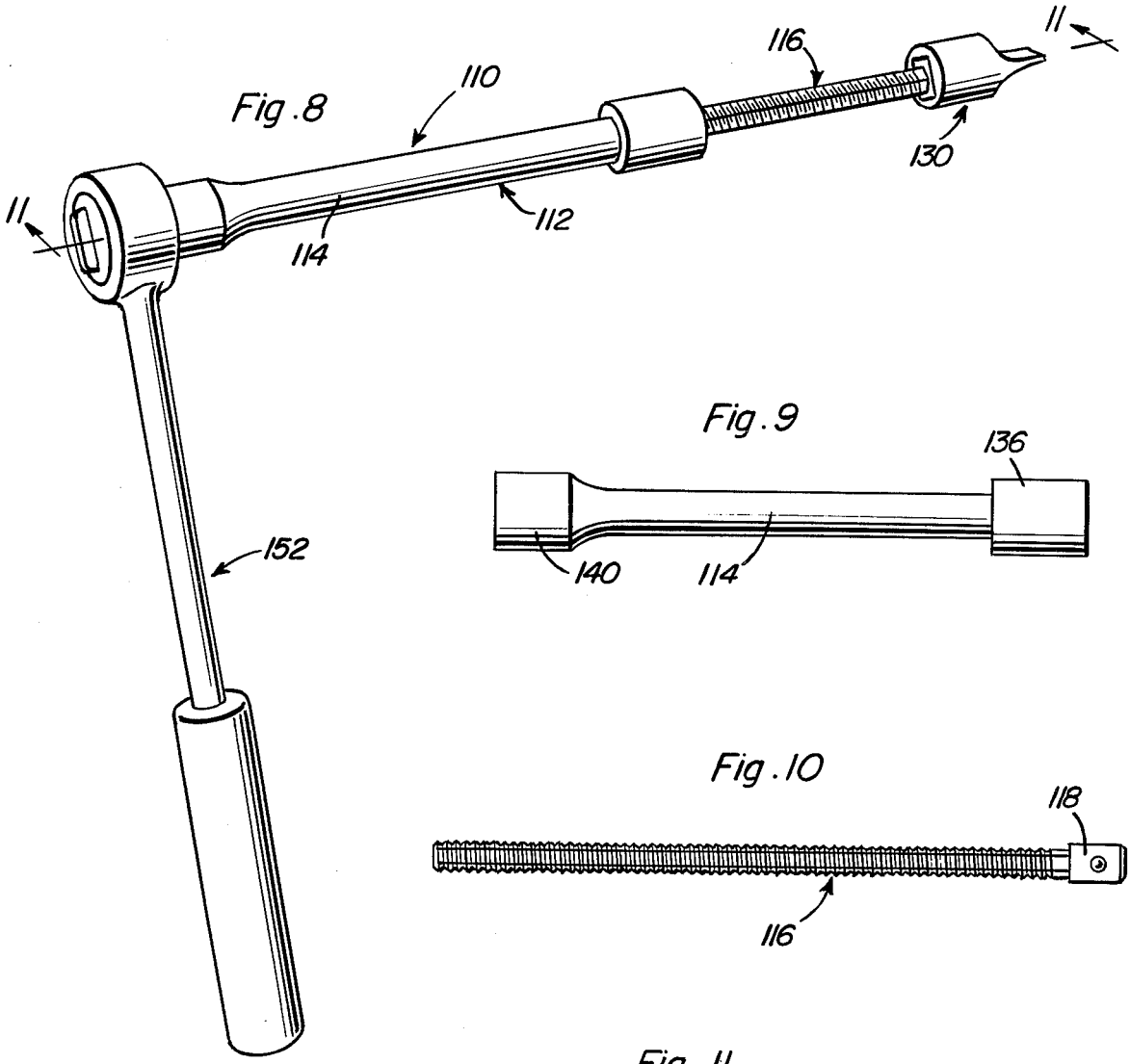
Fig. 8
110
116
11
130
11
114
112
152
Fig. 9
136
140
114
Fig. 10
118
116
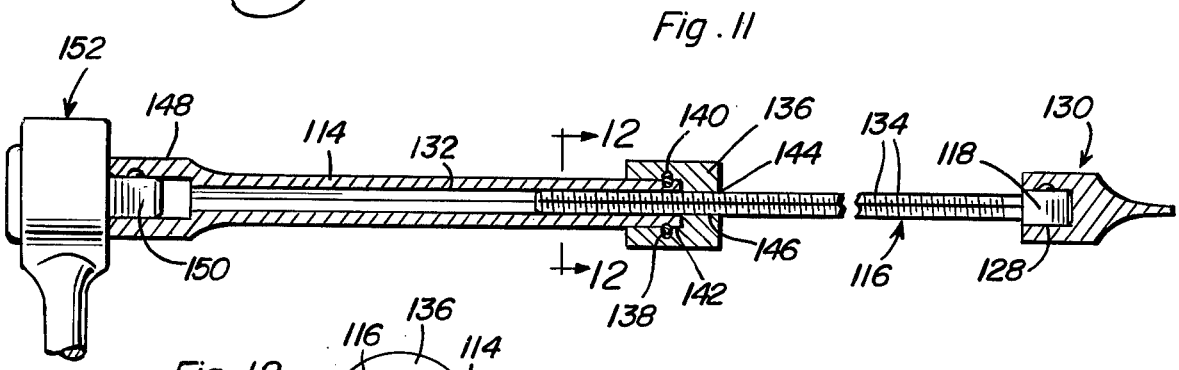
Fig. 11
152
148
114
132
12
140
136
144
134
118
130
150
146
12
138
142
116
128
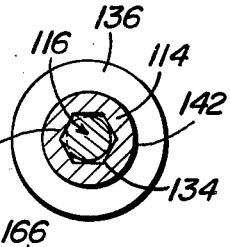
Fig. 12
136
116
114
142
132
134
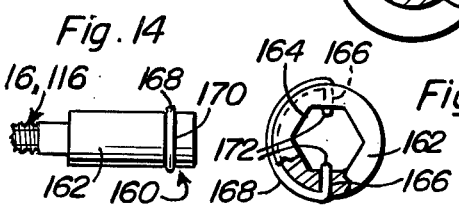
Fig. 14
16, 116
168
170
162
160
164
166
172
162
168
166
Fig. 15
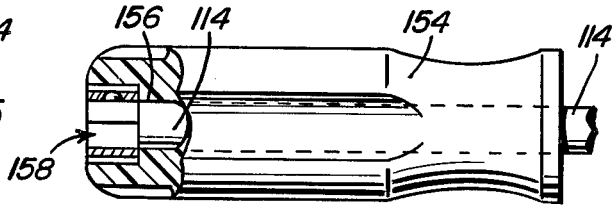
Fig. 13
156
114
154
114
158

VARIABLE-LENGTH TOOL HOLDER

BACKGROUND OF THE INVENTION

1. Field of the Invention

This invention relates generally to a holder for tool bits, and particularly to a variable-length extension designed to vary the length between a driving object and an object being driven.

2. Description of the Prior Art

Driver socket wrench sets are well known and commonly used in various applications, and generally improve the efficiency of a mechanic using such tools. In particular, it is generally desirable to employ an extension with a socket wrench in order to increase the distance between the driving head of the wrench and the bolt head or nut engaging socket. In view of the varying requirements of the distance between the wrench handle and the associated socket, various proposals have been made for providing extensible extensions for socket wrenches and spin-drive handles alike. Examples of extendible bit holders, and the like, can be found in U.S. Pat. No. 524,770, issued Aug. 21, 1894, to O. Smith; U.S. Pat. No. 854,742, issued May 28, 1907, to C. E. Hill; U.S. Pat. No. 1,203,853, issued Nov. 7, 1916, to C. Contal; U.S. Pat. No. 1,269,413, issued June 11, 1918, to J. H. Finnigan; U.S. Pat. No. 1,349,553, issued Aug. 17, 1920, to J. R. Ayotte; U.S. Pat. No. 1,493,983, issued May 13, 1924, to J. C. Hurley; U.S. Pat. No. 2,382,291, issued Aug. 14, 1945, to A. E. Carlberg; U.S. Pat. No. 2,438,633, issued Mar. 30, 1948, to J. Condor; U.S. Pat. No. 2,592,978, issued Apr. 15, 1952, to F. A. Trimboli; and U.S. Pat. No. 3,306,639, issued Feb. 28, 1967, to C. S. Lyon.

It is also well known to provide spin-drive handles, such as used with a conventional screw driver, with ratchet mechanisms so that the driver can be actuated in a reciprocating manner instead of a continuous rotary manner, or with intermittant removal of the driver from the associated fastener, and the like, being driven. Examples of ratchet drivers can be found in U.S. Pat. No. 393,419, issued Nov. 27, 1888, to F. Chantrell; U.S. Pat. No. 2,815,837, issued Dec. 10, 1957, to P. S. Morgan; U.S. Pat. No. 2,989,881, issued June 27, 1961, to R. P. Lavietes; and U.S. Pat. No. 3,824,881, issued July 23, 1974, to R. B. Wright.

U.S. Pat. No. 2,806,706, issued Sept. 17, 1957, to C. E. Fitch, discloses an insert bit and holder which sets forth a rather conventional manner of retaining a tool bit in a bit holder of a driving tool. In this known arrangement, a resilient split ring is inserted into a groove formed in the surface of a socket formed in the bit holder for engaging with an annular groove provided on the shank of the tool bit for retaining the bit in the holder.

SUMMARY OF THE INVENTION

It is an object of the present invention to provide a variable-length extension of simple and inexpensive, yet rugged and reliable construction.

It is another object of the present invention to provide a variable-length extension system usable with either lever or spin-drive actuating handles.

It is yet another object of the present invention to provide an improved bit holding system for use with various driving tools.

These and other objects are achieved according to the present invention by providing a variable-length tool holder having: a shank assembly including a hollow shank, and a shaft adjustably inserted into the hollow shank; and a bit holder mounted on the shaft for retaining a tool bit on the shank assembly.

The hollow shank forms a hole having a non-circular cross section with the shaft also having a non-circular cross section and mating with the cross section of the hole of the shank for rotating with the shank. The shaft is preferably a longitudinally extending element and is provided with external screw threads along a portion of its longitudinal extent. The shank assembly further includes a nut rotatably attached to the shank and provided with an opening having a screw threaded opening mating with the screw threads of the shaft. Internal screw threads provided in the opening of the nut engage with the external screw threads of the shaft, so that rotation of the nut will move the shaft longitudinally relative to the shank for adjusting the length of the shank assembly.

When a spin-drive handle is employed with the shank assembly for rotating same, a counterbore is advantageously provided in communication with a bore extending into the handle for receiving the shank of the shank assembly so as to permit a ratchet device to be anchored in the handle in such a manner as to be coupled to the shank and create a ratchet drive for the shank assembly.

A tool bit holder specifically for use with a variable-length tool holder according to the invention advantageously includes a sleeve provided with an inner passage having a non-circular cross section and with which communicate a pair of radially opposed apertures arranged for receiving the inwardly bent ends of a semi-circular retaining ring anchored in the apertures and arranged about one-half of the outer periphery of the sleeve. The ends of the retaining ring extend into the passage provided in the sleeve a distance sufficient to engage in an annular groove provided in the tool bit being retained so as to hold the bit in the manner of opposed detents. The resiliency of the ring will cause the ends of the ring to behave as though they were spring mounted in their associated apertures.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view showing a first embodiment of a variable-length tool holder according to the present invention.

FIG. 2 is an enlarged, sectional view taken generally along the line 2—2 of FIG. 1.

FIG. 3 is an elevational view showing a tool bit used with the holder of FIGS. 1 and 2.

FIG. 4 is an elevational view showing the sub-assembly generally seen at the right hand portion of FIG. 2, but with the tool bit of FIG. 3 removed.

FIG. 5 is an enlarged sectional view taken generally along the line 5—5 of FIG. 2.

FIG. 6 is an enlarged sectional view taken generally along the line 6—6 of FIG. 2.

FIG. 7 is a fragmentary, side elevational view, partly cut away in a section, showing a modification of the embodiment of the invention seen in FIGS. 1 through 6.

FIG. 8 is a perspective view showing a second embodiment of a variable-length tool holder according to the present invention.

FIG. 9 is an elevational view showing the portion of the second embodiment of the invention generally seen in the center of FIG. 8.

FIG. 10 is a side elevational view showing the portion of the second embodiment of the invention generally seen at the right hand side of FIG. 8, but with the tool bit removed.

FIG. 11 is an enlarged, fragmentary, sectional view taken generally along the line 11—11 of FIG. 8.

FIG. 12 is an enlarged, sectional view taken generally along the line 12—12 of FIG. 11.

FIG. 13 is a side elevational view, partly cut away in a section, showing an optional socket wrench handle for use with the second embodiment of the invention.

FIG. 14 is a fragmentary, elevational view showing a tool bit holder according to the present invention.

FIG. 15 is an enlarged, end elevational view, partly cut away in a section, looking from the right hand side of FIG. 14.

DESCRIPTION OF THE PREFERRED EMBODIMENTS

Description of the Embodiment of the Invention Shown in FIGS. 1 through 6

A variable-length tool holder 10 includes a shank assembly 12 having a hollow shank 14 and a shaft 16, with shaft 16 adjustably inserted into shank 14. Shaft 16 has an end thereof longitudinally spaced from the end of shaft 16 inserted into shank 14, a plug 18 which engages with a bit holder 20 in the form of a sleeve 22 having a non-circular internal section and provided with an internal annular groove 24 in which is disposed a circular split retaining spring 26 which engages with an annular groove 28 provided on the outer periphery of a tool bit 30. As illustrated, bit 30 is in the form of a tool for engaging the slot of a slotted-head screw.

Shank 14 forms a hole 32 extending through the entire longitudinal length of shank 14 and having a non-circular cross section. Shaft 16 also has a non-circular cross section dimensioned to mate with the cross section of hole 32 for causing shaft 16 to rotate with shank 14. As can be appreciated, such an arrangement will permit shaft 16 to slide axially relative to shank 14, even though shaft 16 is restrained from rotational movement relative to shank 14.

Shaft 16 is preferably the illustrated longitudinally extending element provided with external screw threads 34 cut into the non-circular outer surface of the shaft 16. As shown in the drawings, shaft 16, as well as hole 32 of shank 14, have hexagonal cross sections, but it is to be understood that other noncircular sections can be employed, as desired. The screw threads 34 extend along substantially the entire length of shaft 16, with the length of the threads 34 along shaft 16 determining together with the length of shaft 16 and shank 14 the amount of variation in length which can be realized for a given shank assembly 12.

A nut 36 is rotatably attached to shank 14 adjacent the end thereof into which shaft 16 is inserted. This nut 36 is preferably retained on shank 14 as by the illustrated circular split clip 38 received in a groove 39 formed on the outer surface of shank 14 and also in a groove 40 provided in the center side wall of a recess 42 formed at one end of nut 36. Also provided in nut 36 so as to communicate with recess 42 is an opening 44 in which are provided internal screw threads 46. It will be appreciated that opening 44 has a circular cross-sectional shape of a diameter which will receive the shaft 16, and with the screw threads 46 threadedly engaging the threads 34. In this manner, rotation of nut 36 will move shaft 16 longitudinally relative to the shank 14 for adjusting the length of shank assembly 12. As perhaps can best be seen from FIG. 5, the screw threads 34 and 46 are cut into their associated members in such a manner that rotation of nut 36 relative to shaft 16 is impossible even though the shaft 16 has a non-circular cross section. This is so because the threads 34 are cut only at the corner of the, for example, hexagonal section of shaft 16, and on a radius in the case of threads 34 so that the threaded members can rotate relative to one another due to engagement between the threads only along the corners of the shaft 16.

Shank assembly 12 further includes a handle arrangement in the form of a handle 48 removably connected to shank 14 for facilitating rotation of shank 14 in order to actuate the shank assembly 12. More specifically, handle 48 has a bore 50 arranged extending, in the illustrated case, completely through handle 48 in order to receive a portion of shank 14. In the illustrated embodiment, shank 14 is inserted into bore 50 in such a manner as to permit rotation of shank 14 relative to handle 48 and for this purpose, a suitable bearing plate 52 is provided at the opening of bore 50 into which shank 14 is inserted. A counterbore 54 is provided at the end of bore 50 which is longitudinally spaced from bearing plate 52, and a conventional ratchet device 56 is disposed in this counterbore 54 and anchored against movement axially of shank assembly 12 as by the illustrated retaining ring 58. Device 56 will fit in counterbore 54 in such a manner as to prevent rotation of device 56 relative to handle 48, and a suitable key (not shown) may be employed, if desired, to prevent such rotation. Device 56 has, in the conventional manner, a projection 60 which engages in hole 32 of shank 14 in order to operably connect shank 14 to device 56. As can be appreciated, appropriate manipulation of device 56 will cause projection 60 to rotate relative to the main portion of device 56, and handle 48, in one direction of rotation of holder 10, while locking projection 60 relative to the main portion of device 56, and handle 48, in the other direction of holder 10 in order to cause rotation of shank assembly 12.

Description of the Modification Shown in FIG. 7 of the Drawings

Holder 10 can be slightly modified by use of a handle 48' which does not necessarily have a counterbore 54 and ratchet device 56, — shank 14 being slidably keyed to handle 48' in a conventional manner (not shown) — but receives a key-shaped turning bar 62 provided with a boss 64 having formed therein a cavity 66 which fits over the free end of handle 48'. Hole 65 permits access to a ratchet 58 when bar 62 is employed with a handle 48. The latter is preferably provided with flutes 68 which engage in channels 70 provided in cavity 66 of turning bar 62 so as to extend substantially parallel to the extent of handle 48' and slidably engage with flutes 68. In this manner, turning bar 62 may be slidably placed on and removed from handle 48', while being restrained from rotational movement relative to handle 48' in order to facilitate rotation of the associated holder.

Description of the Embodiment of the Invention Shown in FIGS. 8 through 12 of the drawings A holder 110 is constructed around the same basic elements as holder 10 inasmuch as it includes a shank assembly 112 having a hollow shank 114 and a shaft 116 slidably fitted together. A plug 118 is provided on shaft 116 at an end of thereof spaced longitudinally from the end of shaft 116 which is inserted into shank 114. More specifically, plug 118 is similar in function to plug 18 inasmuch as plug 118 is removably insertable into a socket 128 provided in a tool bit 130.

Shank 114 is provided with a hole 132 which can be identical in configuration to hole 32. Further, shaft 116 is provided with external screw threads 134 similar to threads 34, and a nut 136 substantially identical to nut 36 is retained on shank 114 by a clip 138 disposed in a groove 140 provided in the center wall of a recess 142 of nut 136. The latter is also provided with an opening 144 communicating with recess 142 and provided with internal screw threads 146 which engage with screw threads 134 in a manner similar to threads 34 and 46.

Shank assembly 112 differs from shank assembly 12 basically in the configuration of shank 114. At the end of shank 114 which is spaced longitudinally from the end thereof in which shaft 116 is inserted, shank 114 flares outwardly into an enlarged portion forming a socket 148 arranged for receiving a projecting member 150 of a conventional reversible ratchet wrench 152, and the like. In this manner, a conventional wrench 152 may be employed with holder 110 to form a variable-length extension driving tool.

Description of the Modification Shown in FIG. 13 of the Drawings

A conventional ratchet wrench 152 (FIG. 8), and the like, can be used with a spin-drive handle such as that designated 154 for forming a holder according to the invention which can be used either as a spin-drive or lever actuated tool. This handle 154 is provided with a bore 156 in the rear or butt end thereof, which bore 156 in which is affixed a shank 114. Bore 156 terminates in a socket 158 of non-circular section arranged for receiving the projecting member 150 (FIG. 11) of wrench 152 in order to easily adapt the holder incorporating handle 154 to lever actuation.

Operation of the Embodiments Described Above

Operation of both of the above described embodiments is similar inasmuch as they employ the same variable-length adjustment system. As can be appreciated, rotation of the nut 36, 136 will cause shaft 16, 116 to move axially with respect to shank 114 and thus vary the over-all length of the associated shank assembly 12, 112. A particularly advantageous feature of this arrangement is that the adjustment will automatically lock at a predetermined setting of the length of the shank assembly. That is, when driving with a shank assembly 12, 112, shaft 116 cannot move relative to shank 114 inasmuch as rotational forces will not be applied to the associated nut 36, 136 so as to vary the length of the shank assembly 12, 112 during operation of a holder 10, 110. Thus, the present invention realizes a self-locking variable-length extension usable with either a lever or spin-drive actuating handle.

Description of the Bit Holder Shown in FIGS. 14 and 15 of the Drawings

A bit holder 160 according to the present invention includes a sleeve 162 provided with a through passage 164 of non-circular section and having in the walls therein so as to communicate with passage 164 a pair of radially opposed apertures 166. A semi-circular split ring 168 constructed from a resilient material is disposed in a semi-annular groove 170 formed on the outer surface of sleeve 162 so that a pair of ends 172 of ring 168, bent as to lie along a common axis and directed toward one another, can be received in apertures 166. As can be seen from FIG. 15, the ends 172 will extend into passage 164 a distance sufficient so that they will be engaged in a, for example, conventional annular groove, such as groove 28 shown in FIG. 3, provided on the outer surface of a tool bit in order to retain the tool bit within the sleeve 162. It will be appreciated that ring 168 will provide a resilient effect to ends 172 thereof so that the ends 172 will function as spring loaded detents. In this manner, a tool bit can be retained in bit holder 160 in a simple, yet reliable manner.

SUMMARY

As can be readily understood from the above description and from the drawings, a variable-length tool holder according to the present invention provides a system which permits the holder to be used in any driving tool bit application. Further, both the varying in the length of the holder and the holding of the tool bit can be accomplished in a very simple and inexpensive manner, yet one that is rugged and reliable. Further, the holders are inserted into their associated handles in such a manner as to be easily removable, so that shank assemblies of different length ranges and tool bits attached can be used with a given set of handles in order to provide great flexibility for the system.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A variable-length tool holder, comprising, in combination:

(a) a shank assembly including a hollow shank, and a shaft adjustably inserted into the hollow shank; and (b) bit holder means mounted on the shaft for retaining a tool bit on the shank assembly, the hollow shank forming a hole having a non-circular cross section, with the shaft also having a non-circular cross section and mating with the cross section of the hole for rotating with the shank while being slidably disposed within the shank, the shaft being a longitudinally extending element provided with external screw threads along a portion of the longitudinal extent thereof, the shank assembly further including a nut rotatably attached to the shank and having an opening receiving the shaft, and internal screw threads provided in the opening of the nut for engaging with the external screw threads of the shaft, rotation of the nut moving the shaft longitudinally relative to the shank for varying the length of the shank assembly.

2. A structure as defined in claim 1, wherein the shank assembly further includes handle means removably connected to the shank for facilitating rotation of the shank.

3. A structure as defined in claim 2, wherein the handle means includes a handle having a bore arranged receiving a portion of the shank.

4. A structure as defined in claim 3, wherein the handle has an end spaced from a point on the handle where the shaft is inserted into the bore of the handle, the end of the handle being provided with a socket arranged for receiving a projecting member of a wrench arrangeable for facilitating rotation of the handle.

5. A structure as defined in claim 3, wherein the handle further has an end spaced from a point on the handle where the shaft is inserted into the bore of the handle, and the handle being further provided with a counterbore provided at the afore-mentioned end of the handle and communicating with the bore, the shank assembly further including a ratchet device anchored in the counterbore and engaging the shank for controlling the direction in which the shank will rotate together with the handle.

6. A structure as defined in claim 3, wherein the handle is provided with an end spaced from a point on the handle where the shaft is inserted into the bore of the handle, and wherein the shank assembly further includes a T-shaped turning bar provided with a cavity arranged for receiving the end of the handle, the handle being provided with at least one flute disposed longitudinally of an extent of the shank assembly, and the cavity having a groove arranged for slidably receiving the flute and preventing relative rotation between the handle and turning bar.

7. A structure as defined in claim 1, wherein the bit holder means includes a sleeve provided with a through passage for receiving the shank of a tool bit, and a pair of opposed apertures provided in the sleeve and communicating with the passage, a semi-circular ring arranged about a portion of the periphery of the sleeve, the ring being provided with ends bent toward one another so as to lie on a common axis, the ends of the ring being disposed in the apertures so as to extend partially into the passage of the sleeve in order to engage in a groove provided on the outer surface of the tool bit and retain the tool bit in the sleeve.

* * * * *